United States Patent [19]

Czerewaty

[11] 4,248,549

[45] Feb. 3, 1981

[54] APPARATUS FOR ANCHORING A PLATFORM AT AN OFFSHORE LOCATION

[75] Inventor: Frank P. Czerewaty, Houston, Tex.

[73] Assignee: Cameron Iron Works, Inc., Houston, Tex.

[21] Appl. No.: 47,263

[22] Filed: Jun. 11, 1979

[51] Int. Cl.[3] ..... E02D 5/54

[52] U.S. Cl. ..... 405/224; 24/115 R; 405/195

[58] Field of Search ..... 405/195, 224, 201-208, 405/227, 225; 24/115 R, 115 G, 115 A, 115 CH, 122.3, 120, 121; 114/293, 294, 295, 216, 298, 299, 311; 57/7, 215, 217, 219, 221

[56] References Cited

U.S. PATENT DOCUMENTS

| | | | |
|---|---|---|---|
| 1,643,110 | 9/1927 | Briggs | 24/115 R |
| 1,730,155 | 10/1929 | Martin | 24/115 R |
| 2,024,880 | 12/1935 | Rydquist | 24/115 |
| 2,032,567 | 3/1936 | Fiege | 24/115 R |
| 2,529,486 | 11/1950 | Clarkson et al. | 114/294 X |
| 2,742,865 | 4/1956 | Chandler et al. | 24/129 R X |
| 2,980,378 | 4/1961 | Bethea | 24/115 R X |
| 3,709,182 | 1/1973 | Horton | 114/294 |
| 3,901,610 | 8/1975 | Mason | 24/115 A |
| 4,118,838 | 10/1978 | Schiefer et al. | 24/115 G X |

FOREIGN PATENT DOCUMENTS

| | | | |
|---|---|---|---|
| 1280157 | 9/1960 | France | 114/293 |

*Primary Examiner*—Dennis L. Taylor

*Attorney, Agent, or Firm*—Marvin B. Eickenroht; Jennings B. Thompson

[57] ABSTRACT

Apparatus is disclosed in which a flexible line having its lower end anchored to a base fixedly mounted at an offshore location extends through an upwardly flared opening in the base for connection to a tension leg platform on the surface of the ocean.

3 Claims, 3 Drawing Figures

APPARATUS FOR ANCHORING A PLATFORM AT AN OFFSHORE LOCATION

This invention relates generally to apparatus for anchoring a platform at an offshore location; and, more particularly, to improved apparatus of this type having flexible lines especially well suited for use as tension legs in anchoring the platform.

Platforms of the tension leg type, which have been designed for both drilling and production purposes in deep offshore environments, are held on location by flexible lines which are anchored to bases fixedly mounted on the ocean floor beneath the platform. The wire rope from which each line is made may be subjected to as much as three million pounds of tensile force, and therefore may be as much as eight inches in diameter. Also, the line must be able to bend at an angle of up to about 10° with respect to the vertical, as the platform shifts laterally with respect to the ocean floor, without inducing significant bending stress in the line.

An object of this invention is to provide apparatus of this type having flexible lines of such construction and so anchored to the ocean floor as to prevent bending beyond such limits and to prevent undue stresses from being imposed thereon when so bent.

Another object is to provide such a line which minimizes high contact stresses and abrasion of the wire rope, and which limits bending stresses therein, so as to enable the line to have an extended, relatively maintenance-free life.

These and other objects are accomplished, in accordance with the illustrated embodiment of the invention, by apparatus which includes a base adapted to be fixedly connected at the subsurface beneath the platform and having means thereon providing a substantially vertical opening therethrough, and a line of flexible wire rope which has its lower end anchored to the base and which passes through the opening for extension upwardly to the platform. The opening is flared upwardly along a gradually curved surface so as to limit the extent to which the line is bent, as it is forced thereagainst, to an angle of not more than 10° with respect to the vertical axis of the opening.

The flexible rope is made up of a cluster of strands each including multiple metal wires, and sleeves of ductile material which are spaced apart along the rope and which have inner surfaces fitting closely about the cluster of strands to conform generally with the irregular exterior surfaces thereof. In this way, as the line is caused to bend along the flared opening, the sleeves, which may be made of hard rubber, distribute the contact stresses otherwise induced between the outer wires of the strand and the sleeves over a large number of wires, thus providing the rope with greater fatigue life.

Each sleeve of each line is carried by a ring of rigid material having an outer, generally cylindrical surface for establishing line contact with the flared upper end of the opening to the base when the line is forced thereagainst. In addition to acting as a buffer to prevent wear on the sleeves which would otherwise contact the flared opening, these rings provide full circle support which prevents the rope from being flattened or distorted when the line is forced against the flared opening in the base, which distortion might not only weaken the rope, but also increase the fatigue in its individual wires, thereby causing early failure. The rings also distribute the contact pressure between the line and the flared opening in the base more uniformly over the full contact area of the rope, whereas, in the absence of the present invention, the pressure would be transferred through line contact between the rope and the surface against which it is forced.

In the illustrated embodiment of the invention the base comprises an upright tubular body, and an assembly having a lower end which is lowerable into the tubular body. The assembly includes a socket to which the lower end of the line is anchored, a quide member above the socket through which the flared opening is formed, and means for releasably connecting the assembly to the tubular body when it is so lowered.

Each ring and sleeve carried thereby are split longitudinally into segments for assembly about the rope, and a means is provided for tightly clamping the ring segments about the sleeve segments, thus holding the sleeve segments in tight conformity with the irregular surfaces on the exterior of adjacent strands and adjacent wires of each strand of rope.

Figure 1:
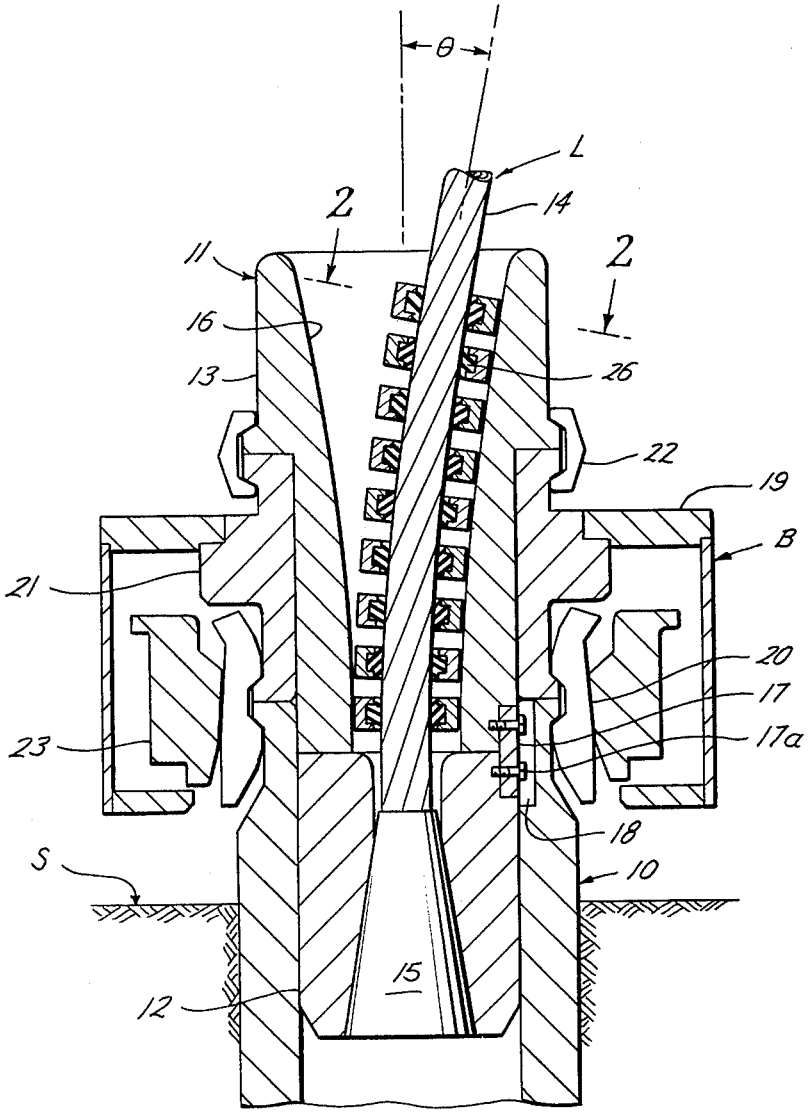
FIG. 1 is a vertical sectional view of apparatus constructed in accordance with the present invention, including a base fixedly mounted at the subsurface, and a line having its lower end anchored to and extending upwardly through a flared opening formed in the base.

With reference now to the details of the above-described drawings, and particularly FIG. 1 thereof, the base B comprises a tubular body 10 which is fixedly mounted in an upright position on the subsurface S of an offshore location below a platform (not shown), and an assembly 11 having its lower end received within the tubular body. The assembly includes a socket 12 at its lower end and a guide member 13 above the socket, and a line L is anchored to the socket 12 by means of a flared portion on its lower end which fits closely within a correspondingly flared opening in the lower end of socket 12. The line extends upwardly from the socket through a vertical opening 16 through the guide member 13 which is flared upwardly along a gradually curved surface so that a tangent at any point along its surface forms an angle $\theta$ of not more then 10° with respect to the axis of the opening 16.

In the illustrated embodiment of the invention, the socket 12 and guide member 13 are releasably connected to one another, as by means of a connector 17 on one side thereof, with their substantially equal outer diameters aligned for fitting closely within the tubular body 10. As the assembly comprising the socket and guide member is lowered into the tubular body, the outwardly protruding ends of connector bolts 17*a* fit within a vertical slot 18 in the upper end of the inner diameter of tubular body 10 to maintain the assembly against rotation.

When lowered into the tubular body, the assembly is releasably connected thereto by a connector 19 having locking dogs 20 which are carried by a connector body 21 releasably connected to the guide member 13 by means of a clamp 22. The locking dogs are free to tilt between the locked position of FIG. 1, wherein they engage tapered shoulders on the lower end of connector body 21 and the upper end of tubular body 10, and a released position (not shown) in which their lower ends are moved outwardly from beneath the tapered shoulder on body 10 to permit them to be moved vertically thereover, either during connection or disconnection of the assembly. The locking dogs are moved between locking and unlocking position by means of a reciprocable locking ring 23 movable between alternate positions in any suitable manner.

As will be appreciated, FIG. 1 merely illustrates one of several anchored lines which would be used in anchoring a platform at an offshore location. This invention contemplates, however, that each such line would be so anchored and constructed.

As previously described, each line L includes a flexible rope 14 made up of a cluster of strands 24, each including multiple steel wires. As well known in the art, the wires as well as strands are twisted with respect to the length of the wire or strand, and a filler material 25 of suitable plastic material may be molded within the outer cluster of strands and about a center strand. A rope of this construction is more fully disclosed in U.S. Pat. No. 3,800,522.

Figure 2:
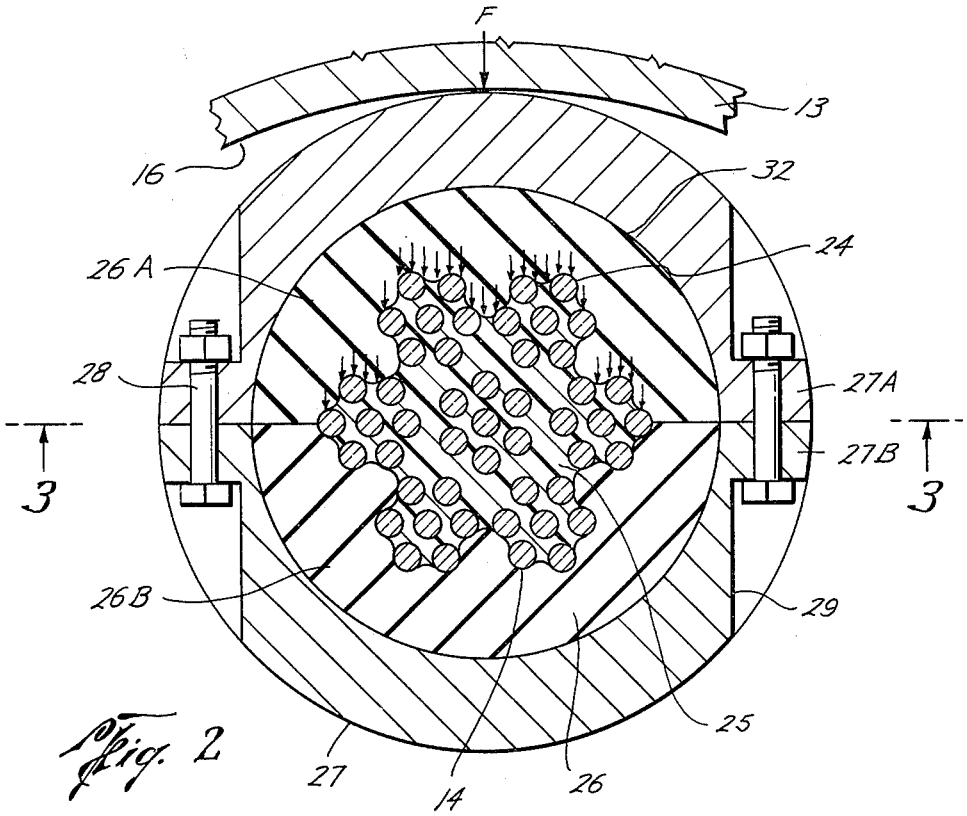
FIG. 2 is a cross-sectional view, on an enlarged scale, of a portion of the base and the line extending therethrough, as seen along broken lines 2—2 of FIG. 1.

In accordance with the present invention, however, and as previously described, line L also includes a plurality of sleeves 26 which are spaced apart along the length of the rope and comprise longitudinally split segments 26A and 26B which are clamped about the rope, as will be described to follow. More particularly, the inner surfaces of the sleeve segments, which may be molded of a ductile material, such as hard rubber, conform to the irregular outer surface of the wire rope, and thus to the irregularities resulting from the exterior portions of the strands and the individual wires of each strand. As best shown in FIG. 2, the segments 26A and 26B are of semi-circular shape in cross section whose opposite faces are brought into substantial contact as such segments are clamped about the wire rope.

Figure 3:
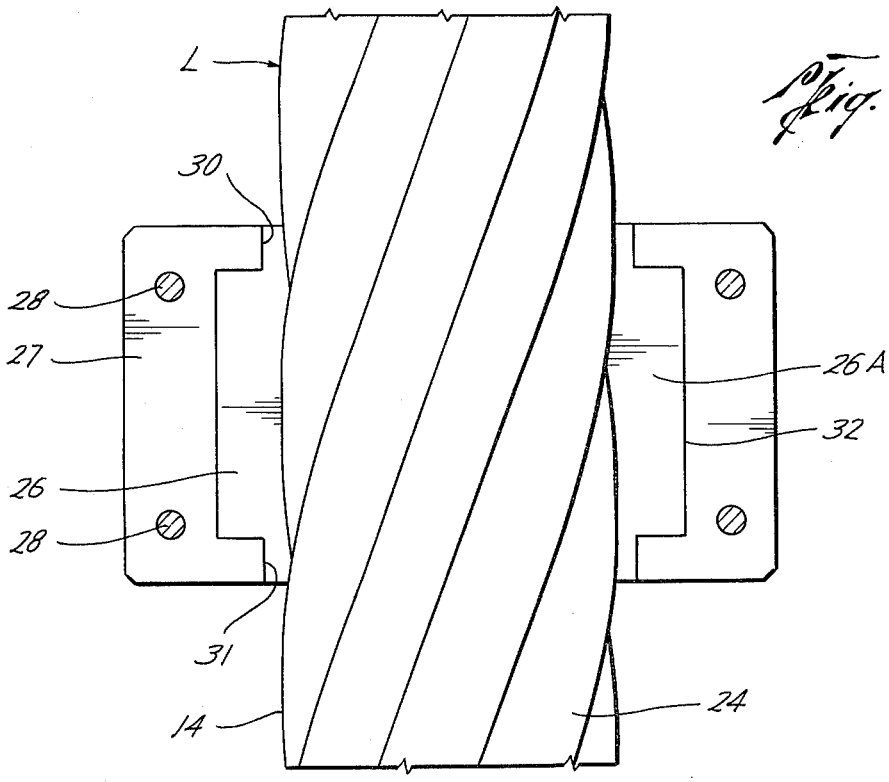
FIG. 3 is a longitudinal sectional view of a portion of the line, as seen along broken lines 3—3 of FIG. 2.

The line also includes rings 27 of rigid material each of which carries a sleeve 26 to hold its inner surfaces in conformity with the wire rope. Adjacent rings are spaced from one another along the length of the rope so that the line is free to flex, as shown in FIG. 1. As best shown in FIG. 3, the inner surfaces of the ring segments are recessed to form upper and lower flanges 30 and 31 which receive annular enlargements 32 about the sleeve segments to support each sleeve within a ring.

More particularly, the rings, which may be made of metal, are also formed in segments which are separated from one another in alignment with the separation between the sleeve segments. The opposite faces of the ring segments substantially abut one another, when clamped about the sleeve to provide an outer cylindrical surface which forms a line contact with the flared opening 16 of the base when the line is bent to its maximum extent.

The ring segments are clamped about the sleeve by means of bolts 28. As best shown in FIG. 3, the rings are recessed at 29 to receive the bolts and nuts on the ends of the bolts 28, so that no portion thereof engages with the flared opening 16. As will be apparent, upon disconnecton of the bolts, the ring segments and the sleeve segments carried thereby, may be moved laterally off of or onto the rope. Preferably the sleeve segments are molded to the inner diameters of the ring segments.

As shown in FIG. 1, the spacing between the rings and sleeves along the length of line A is such that they maintain the line out of contact with opening 16 when forced thereagainst. As also indicated by the arrows of FIG. 2, when the line is bent against opening 16, the contact stress caused by the force F, due to tension being held in the line, is transmitted from the rings and through the ductile sleeves so as to be distributed over a large number of wires of the strands of the wire rope. Thus, as previously described, the stress in each individual wire is considerably less than the stress which would be imposed thereon if the line were made up of a conventional wire rope. Furthermore, and as also previously described, rings 27 not only maintain the outer surface of the sleeves of ductile material out of engagement with surface 16, but also provides full circle support for the sleeves, which prevents the wire rope from being flattened or distorted.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for anchoring a platform at an offshore location, comprising a base adapted to be fixedly mounted at the subsurface beneath the platform, means on the base providing a substantially vertical opening therethrough whose upper end is flared outwardly along a gradually curved surface, a line having its lower end anchored to the base and passing through said opening for extension upwardly to said platform, each line comprising a flexible rope made up of a cluster of strands each including multiple metal wires, and a plurality of rings of rigid material surrounding said rope in spaced apart relation along the portion of the line which passes through the flared upper end of the opening through the base so as to maintain the rope out of contact therewith, and a sleeve of ductile material carried within each ring and having an inner surface which fits closely about the rope to conform generally with the irregular exterior surfaces between adjacent strands and between adjacent wires of each strand, each ring having a generally cylindrical outer surface for establishing line contact with the flared upper end of the opening when the line is forced thereagainst.

2. Apparatus of the character defined in claim 1, wherein the base comprises an upright tubular body, and the means on the base comprises an assembly having a lower end which is lowerable into said tubular body, said assembly including a socket to which the lower end of the line is anchored, a guide member above the socket through which the flared opening is formed, and means for releasably connecting the assembly to the tubular body when so lowered.

3. Apparatus of the character defined in claim 1, wherein tangents to the surfaces of the flared upper end of the opening form angles of not substantially more than 10° with respect to the axis of such opening.

* * * * *